US010467948B2

(12) United States Patent
Kim et al.

(10) Patent No.: US 10,467,948 B2
(45) Date of Patent: Nov. 5, 2019

(54) DISPLAY DRIVING DEVICE

(71) Applicant: SILICON WORKS CO., LTD., Daejeon-si (KR)

(72) Inventors: Young Bok Kim, Daejeon-si (KR); Taiming Piao, Seoul (KR); Hyun Kyu Jeon, Daejeon-si (KR); Joon Ho Na, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 0 days.

(21) Appl. No.: 15/792,946

(22) Filed: Oct. 25, 2017

(65) Prior Publication Data

US 2018/0122291 A1 May 3, 2018

(30) Foreign Application Priority Data

Oct. 27, 2016 (KR) ..... 10-2016-0140755

(51) Int. Cl.

| | |
|---|---|
| ***G09G 3/36*** | (2006.01) |
| ***G09G 3/20*** | (2006.01) |
| ***G09G 3/3258*** | (2016.01) |

(52) U.S. Cl.

CPC ..... *G09G 3/2092* (2013.01); *G09G 3/20* (2013.01); *G09G 3/3258* (2013.01); *G09G 3/3614* (2013.01); *G09G 3/3648* (2013.01); *G09G 3/3696* (2013.01); *G09G 2300/0828* (2013.01); *G09G 2310/027* (2013.01); *G09G 2310/0291* (2013.01); *G09G 2320/0223* (2013.01)

(58) Field of Classification Search

USPC ..... 345/100, 212, 213, 690, 98, 204, 214; 315/291; 360/55; 378/46; 341/143

See application file for complete search history.

(56) References Cited

U.S. PATENT DOCUMENTS

| | | | | |
|---|---|---|---|---|
| 6,384,817 | B1 * | 5/2002 | Janssen | G09G 3/2011 345/204 |
| 9,001,092 | B2 | 4/2015 | Kim | |
| 2002/0175890 | A1 * | 11/2002 | Dosho | G09G 3/3685 345/100 |
| 2004/0090409 | A1 | 5/2004 | Nakata et al. | |
| 2010/0164396 | A1 * | 7/2010 | Lindeberg | H05B 33/0818 315/291 |
| 2011/0001746 | A1 * | 1/2011 | Kim | G02B 27/2264 345/213 |
| 2011/0032633 | A1 * | 2/2011 | Carson | G11B 5/553 360/55 |

(Continued)

FOREIGN PATENT DOCUMENTS

| | | |
|---|---|---|
| KR | 10-0755939 | 9/2007 |
| KR | 10-0971088 | 7/2010 |

*Primary Examiner* — Thuy N Pardo

(74) *Attorney, Agent, or Firm* — Polsinelli PC

(57) ABSTRACT

Disclosed is a display driving device capable of reducing an output response delay of an output buffer. The display driving device may include: a first DAC configured to load a first grayscale voltage corresponding to first digital data as a first DAC signal; a second DAC configured to load a second grayscale voltage corresponding to second digital data as a second DAC signal; and an output buffer configured to alternately select the first DAC signal loaded to a first input terminal and the second DAC signal loaded to a second input terminal.

16 Claims, 3 Drawing Sheets

(56) References Cited

U.S. PATENT DOCUMENTS

| | | | | |
|---|---|---|---|---|
| 2013/0170613 | A1* | 7/2013 | Utaka | G01N 23/2206 378/46 |
| 2013/0271305 | A1* | 10/2013 | Kim | H03M 1/785 341/143 |
| 2013/0314392 | A1* | 11/2013 | Kim | G09G 3/20 345/212 |
| 2016/0180764 | A1* | 6/2016 | Noh | G09G 3/2018 345/690 |
| 2018/0088735 | A1* | 3/2018 | Lin | G06F 3/0418 345/98 |

* cited by examiner

DISPLAY DRIVING DEVICE

BACKGROUND

1. Technical Field

The present disclosure relates to a display driving device, and more particularly, to a display driving device capable of reducing a response delay which occurs when a display panel is driven.

2. Related Art

Examples of display devices which are widely used these days may include an LCD (Liquid Crystal Display), PDP (Plasma Display Panel), OLED (Organic Light Emitting Diode), AMOLED (Active Matrix Organic Light Emitting Diode) and the like.

As a display device is implemented with a high resolution configuration, one horizontal period during a source driver can be driven, that is, a line time is gradually reduced. With the reduction of the line time, the source driver is required to have a quick response characteristic in order to output a driving signal to a display panel in response to display data.

The source driver includes a large number of output buffers for outputting source driving signals to the display panel and digital-to-analog converters (DACs) matched with the respective output buffers. Each of the output buffers receives an output of the corresponding DAC, generates a source driving signal corresponding to the output of the DAC, and provides the source driving signal to the display panel. During the above-described process, a response delay of the output buffer may occur.

The response delay of each output buffer interferes with a fast output of the source driving signal in response to the display data. Therefore, the response delay of the output buffer acts as an obstacle to the development of a display device to have a little line time for implementing a high resolution configuration.

In particular, the response delay of the output buffer may be caused by input parasitic capacitance, for example. The output buffer configured for each channel to output the source driving signal has input parasitic capacitance at an input terminal thereof. The input parasitic capacitance may be formed by a switching operation of a switch connected to a line of the input terminal of the output buffer, and cause a resistive-capacitive (RC) delay in connection with a resistor string of a gamma circuit or routing resistance which occurs depending on routing.

The RC delay of the input terminal of the output buffer has an influence on a response delay, and restricts the source driver from processing display data within a little line time in order to implement a high resolution display.

SUMMARY

Various embodiments are directed to a display driving device capable of reducing a response delay of an output buffer by improving a method of providing a DAC signal corresponding to display data to an input terminal of an output buffer.

Also, various embodiments are directed to a display driving device capable of reducing a response delay caused by input parasitic capacitance of an input terminal of an output buffer, thereby applying a little line time for a high-resolution display.

In an embodiment, a display driving device may include: a first DAC configured to output a first grayscale voltage selected in response to first digital data as a first DAC signal; a second DAC configured to output a second grayscale voltage selected in response to second digital data as a second DAC signal, wherein the first digital data and the second digital data are alternately inputted; and an output buffer including a first input terminal to which the first DAC signal is loaded and a second input terminal to which the second DAC signal is loaded, and configured to output a source driving signal by selecting a DAC signal loaded at a preset level or more between the first and second DAC signals which are loaded at different time points.

In another embodiment, a display driving device may include: a first output unit configured to output a first source driving signal in the range of a first supply voltage to a second supply voltage; a second output unit configured to output a second source driving signal in the range of the second supply voltage to a third supply voltage; and a multiplexer configured to control paths through which the first and second source driving signals are outputted to a display panel. The first output unit may include: a first DAC configured to output a first grayscale voltage selected in response to first digital data as a first DAC signal; a second DAC configured to output a second grayscale voltage selected in response to second digital data as a second DAC signal; and a first output buffer including a first input terminal to which the first DAC signal is loaded and a second input terminal to which the second DAC signal is loaded, and configured to output the first source driving signal by selecting a DAC signal loaded at a preset level or more between the first and second DAC signals which are loaded at different time points. The second output unit may include: a third DAC configured to output a third grayscale voltage selected in response to third digital data as a third DAC signal; a fourth DAC configured to output a fourth grayscale voltage selected in response to fourth digital data as a fourth DAC signal; and a second output buffer including a third input terminal to which the third DAC signal is loaded and a fourth input terminal to which the fourth DAC signal is loaded, and configured to output the second source driving signal by selecting a DAC signal loaded at the preset level or more between the third and fourth DAC signals which are loaded at different time points.

According to the embodiments of the present invention, the display driving device can improve the method of providing a DAC signal to an input terminal of the output buffer, thereby reducing a response delay of the output buffer in response to display data by.

Furthermore, the display driving device can apply a little line time for a high-resolution display through the reduction of the response delay of the output buffer.

DETAILED DESCRIPTION

Figure 1:
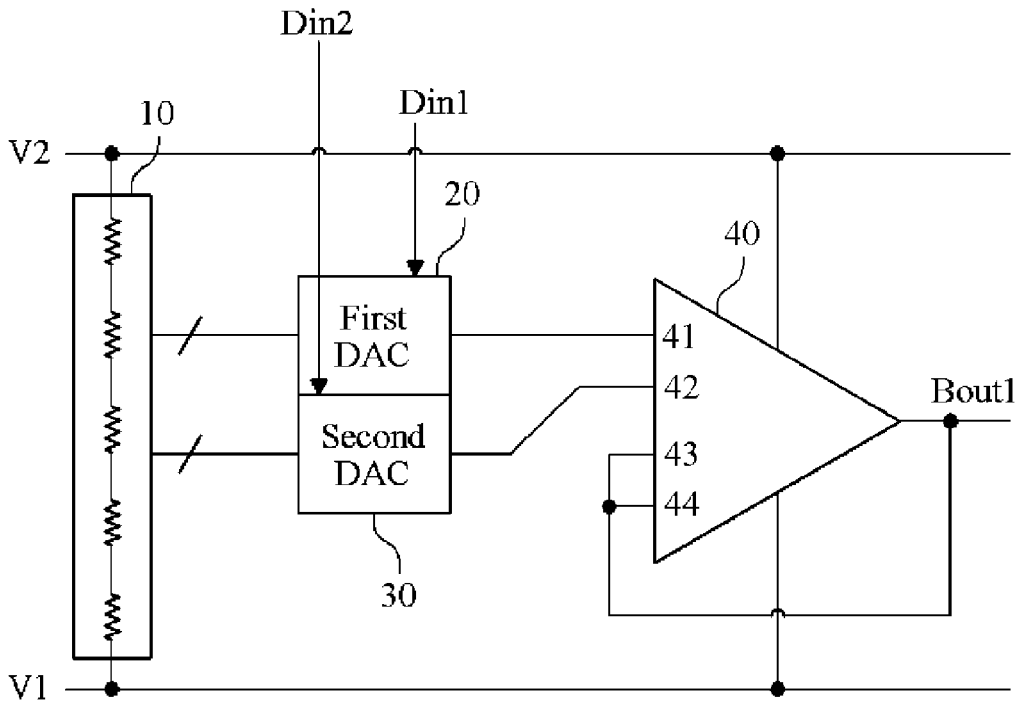
FIG. 1 is a circuit diagram illustrating a display driving device according to an embodiment of the present invention.

Hereafter, embodiments of the present invention will be described in detail with reference to the accompanying drawings. The terms used in the present specification and claims are not limited to typical dictionary definitions, but must be interpreted as meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

FIG. 1 is a circuit diagram illustrating a display driving device according to an embodiment of the present invention.

The display driving device of FIG. 1 includes a gamma voltage provider 10, a first digital-to-analog converter (DAC) 20, a second DAC 30 and an output buffer 40.

The display driving device may be understood as a source driver that provides a source driving signal Bout to a display panel (not illustrated). A plurality of display driving devices may be configured for one display panel. The display panel displays an image using a source driving signal Bout1 of the output buffer 40 of the display driving device.

The display panel may include an LCD (Liquid Crystal Display) panel, OLED (Organic Light Emitting Diode) display panel, AMOLED (Active Matrix Organic Light Emitting Diode) display panel and the like.

The image is expressed in a frame basis, and each frame includes a plurality of horizontal lines. One horizontal line is driven by a plurality of display driving devices. Each of the display driving devices has a large number of output channels, and the output channels correspond to the respective pixels of the corresponding horizontal line.

The display driving device processes display data in a line basis. In the present embodiment, the display data may be understood as data corresponding to the respective pixels among data of the horizontal line allocated to the display driving device. The display data may have an N-bit digital value for expressing the grayscales of the pixels.

The gamma voltage provider 10 provides gamma voltages corresponding to the digital values of display data, that is, grayscale values. For this operation, the gamma voltage provider 10 may include a resistor string having a plurality of resistors connected in series. The resistor string of the gamma voltage provider 10 receives voltages V1 and V2 having a potential difference through both terminals thereof. Thus, the gamma voltage provider 10 may provide grayscale voltages to the respective nodes of the resistor string. The present embodiment may be based on the supposition that the voltage V1 has a higher level than the voltage V2.

The display data may be subjected to a digital signal process through a latch (not illustrated) and a level shift (not illustrated) in the display driving device, and then provided to the first or second DAC 20 or 30.

At this time, the display data inputted to the first DAC 20 may be defined as first digital data Din1, and the display data inputted to the second DAC 30 may be defined as second digital data Din2.

The first DAC 20 receives the first digital data Din1, selects a grayscale voltage corresponding to the first digital data Din1 among the grayscale voltages of the gamma voltage provider 10, and provides the selected grayscale voltage as a first DAC signal to the output buffer 40.

The second DAC 30 receives the second digital data Din2, selects a grayscale voltage corresponding to the second digital data Din2 among the grayscale voltages of the gamma voltage provider 10, and provides the selected grayscale voltage as a second DAC signal to the output buffer 40.

At this time, the grayscale voltages selected by the first and second DACs 20 and 30 may be decided by the digital values of the first and second digital data Din1 and Din2. The grayscale voltages selected by the first and second DACs 20 and 30 may be equal to each other or different from each other. For convenience of description, the grayscale voltage selected by the first DAC 20 is referred to as a first grayscale voltage, and the grayscale voltage selected by the second DAC 30 is referred to as a second grayscale voltage.

The display driving device of FIG. 1 alternately receives the first digital data Din1 and the second digital data Din2. For example, the first digital data Din1 may be defined as a signal for an odd-numbered horizontal line among the horizontal lines of one frame, and the second digital data Din2 may be defined as a signal for an even-numbered horizontal line.

The display driving device of FIG. 1 is operated to provide the source driving signal Bout1 to one pixel, the source driving signal Bout1 corresponding to the first digital data Din1 of an odd-numbered horizontal line and the second digital data Din2 of an even-numbered horizontal line.

Figure 3:
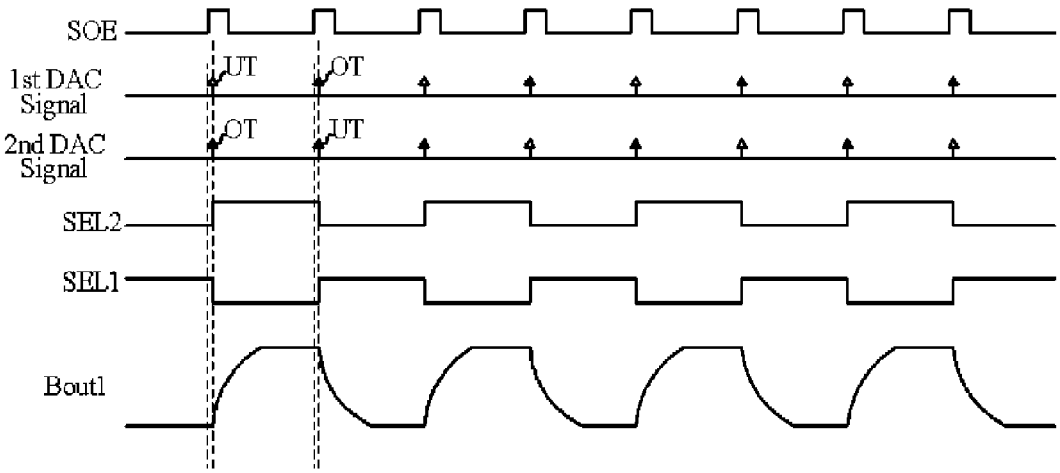
FIG. 3 is a waveform diagram for describing an operation of the embodiment of FIG. 1.

The display driving device may be configured to output the source driving signal Bout1 in each cycle of a source output enable (SOE) signal (refer to FIG. 3). The SOE signal is a control signal which is provided to control an output of the source driving signal Bout1 on a horizontal line basis.

In a first cycle of the SOE signal, the first DAC 20 receives the first digital data Din1, selects a first grayscale voltage corresponding to the first digital data Din1 among the grayscale voltages of the gamma voltage provider 10, and loads the selected first grayscale voltage as the first DAC signal to the output buffer 40. In a second cycle of the SOE signal following the first cycle, the first DAC 20 outputs the first grayscale voltage loaded at a preset level or more as the first DAC signal to the output buffer 40.

In the first cycle of the SOE signal, the second DAC 30 outputs a second grayscale voltage as the second DAC signal to the output buffer 40, the second grayscale voltage being loaded at the preset level or more in the previous cycle. In the second cycle of the SOE signal following the first cycle, the second DAC 30 receives the second digital data Din1, selects the second grayscale voltage corresponding to the second digital data Din1 among the grayscale voltages of the gamma voltage provider 10, and loads the selected second grayscale voltage as the second DAC signal to the output buffer 40. In the next cycle to the second cycle of the SOE signal, the second DAC 30 outputs the second grayscale voltage loaded at the preset level or more as the second DAC signal to the output buffer 40.

In FIG. 3, a point of time that the first or second DAC signal is loaded to the output buffer 40 from the first or second DAC 20 or 30 is represented by "UT", and a point of time that the output buffer 40 selects the first or second DAC signal loaded at the preset level and outputs the selected signal as the source driving signal Bout1 is represented by "OT".

In the present embodiment, while one DAC selects a grayscale voltage and loads a DAC signal to the output buffer 40 in response to the same cycle of the SOE signal, the other DAC outputs a DAC signal to the output buffer 40, the DAC signal being loaded at the preset level in the previous cycle. In other words, the first and second DACs 20 and 30 alternately perform the operation of selecting a grayscale voltage and loading a DAC signal and the operation of outputting the DAC signal loaded at the preset level.

The output buffer 40 may include a first input terminal 41 to which the first DAC signal of the first DAC 20 is loaded and a second input terminal 42 to which the second DAC signal of the second DAC 30 is loaded. The output buffer 40 may select a DAC signal loaded at the preset level or more between the first and second DAC signals which are loaded at different times, and output the selected DAC signal as the source driving signal Bout1.

The output buffer 40 includes third and fourth input terminals 43 and 44. The third input terminal 43 receives the source driving signal Bout1 of an output terminal of the output buffer 40 as a feedback voltage in response to the first DAC signal, and the fourth input terminal 44 receives the source driving signal Bout1 of the output terminal of the output buffer 40 as a feedback voltage in response to the second DAC signal.

The output buffer 40 feeds back the source driving signal Bout1 of the output terminal as the feedback voltage to the third and fourth input terminals 43 and 44 in order to function as a voltage follower.

The output buffer 40 according to the embodiment of the present invention selects a DAC voltage loaded at the preset level between the first and second DAC signals loaded from the first and second DACs 20 and 30, in order to output the source driving signal Bout1. Therefore, since the output buffer 40 selects the first or second DAC signal loaded at the preset level or more and outputs the source driving signal Bout1, the output buffer 40 can reduce the time required for loading the DAC signal through the input terminal thereof while having a quick response characteristic.

In other words, the output buffer 40 can exclude a delay which may be caused by input parasitic capacitance or a configuration for switching grayscale voltages in lines between a plurality of DACs and the output buffer 40, and output the DAC signal loaded at the sufficient level as the source driving signal Bout1.

Therefore, the source driving device according to the embodiment of the present invention can reduce a response delay of the output buffer, which may be caused when an input of the DAC signal is delayed.

Furthermore, the source driving device according to the embodiment of the present invention can reduce a response delay of the output buffer by alternately using two DACs. As a result, the source driving device can remove the influence of a DAC delay on an operation of the display panel.

The detailed configuration of the output buffer 40 will be described with reference to FIG. 2.

Figure 2:
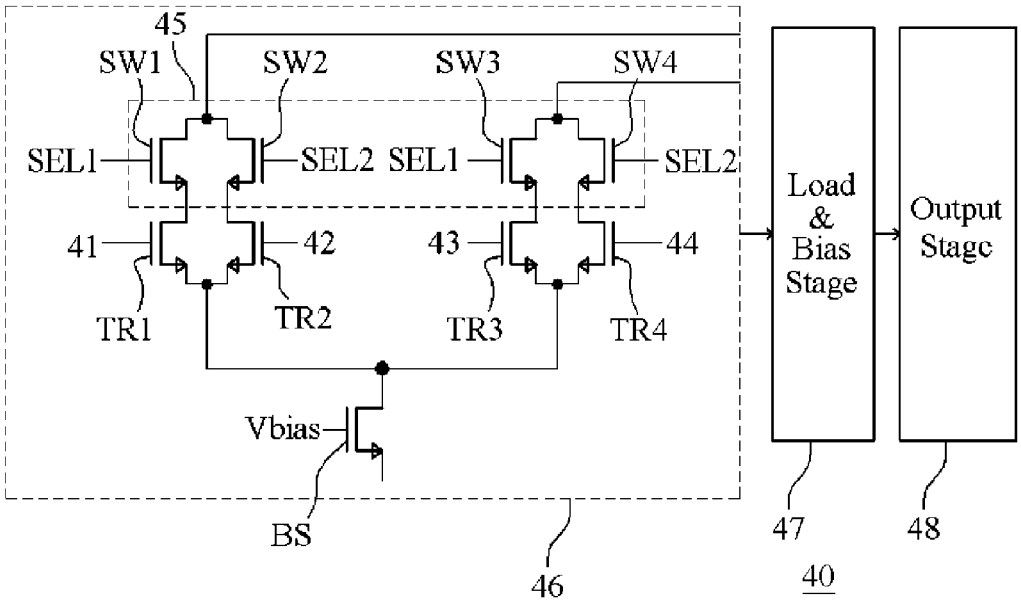
FIG. 2 is a detailed circuit diagram illustrating an output buffer in the embodiment of FIG. 1.

Referring to FIG. 2, the output buffer 40 may include an input stage 46, a load and bias stage 47 and an output stage 48.

The input stage 46 includes a first transistor TR1, a second transistor TR2 and an input multiplexer 45. The first transistor TR1 forms the first input terminal 41 to which the first DAC signal of the first DAC 20 is loaded, the second transistor TR2 forms the second input terminal 42 to which the second DAC signal of the second DAC 30 is loaded, and the input multiplexer 45 selects between a first voltage driven by the first DAC signal and a second voltage driven by the second DAC signal. The first and second input terminals 41 and 42 are formed at the gates of the first and second transistors TR1 and TR2. The first voltage may be understood as a voltage which is driven by the first transistor TR1 operated by the first DAC signal, and the second voltage may be understood as a voltage which is driven by the second transistor TR2 operated by the second DAC signal.

The input stage 46 compares the first or second voltage selected by the input multiplexer 45 to a voltage corresponding to a feedback voltage, generates a comparison signal corresponding to a difference between the selected first or second voltage and the feedback voltage, and provides the comparison signal to the load and bias stage 47. At this time, the feedback voltage may be selected from the first and second feedback voltages of the third and fourth input terminals 43 and 44 of the output buffer 40. This configuration will be described later.

The load and bias stage 47 receives the comparison signal from the input stage 46. Furthermore, the load and bias stage 27 generates pull-up and pull-down driving signals by biasing the comparison signal to signals for driving pull-up and pull-down drivers (not illustrated) of the output stage 48 through current mirroring, and transmits the generated signals to the output stage 48. Since the configuration for current mirroring of the load and bias stage 27 can be embodied by a typical current mirror circuit, the detailed descriptions thereof are omitted herein.

Although not illustrated in the drawing, the output stage 48 may include the pull-up and pull-down drivers which are driven in the range of the first voltage V1 to the second voltage V2. The pull-up driving signal provided by the load and bias stage 47 is transmitted to the pull-up driver of the output stage 28, and the pull-down driving signal provided by the load and bias stage 47 is transmitted to the pull-down driver of the output stage 28. The pull-up driver and the pull-down driver have one common node, and a signal outputted through the common node is the source driving signal Bout1 of the output stage 48.

In the above-described configuration, the input stage 46 may further include a third transistor TR3 forming the third input terminal 43 and a fourth transistor TR4 forming the fourth input terminal 44. The third input terminal 43 receives the first feedback voltage as a feedback signal of the source driving signal Bout1 outputted from the output buffer 40 in response to the first DAC signal, and the fourth input terminal 44 receives a second feedback voltage as a feedback signal of the source driving signal Bout1 outputted from the output buffer 40 in response to the second DAC signal. The third and fourth input terminals 43 and 44 are formed at the gates of the third and fourth transistors TR3 and TR4.

The input stage 46 further includes a bias switch BS. The bias switch BS is connected to the first to fourth transistors TR1 to TR4 in common, and driven by a bias control voltage Vbias.

That is, the first to fourth transistors TR1 to TR4 are connected in parallel between the bias switch BS and the input multiplexer 45. The first to fourth transistors TR1 to TR4 may be implemented with NMOS transistors.

The bias switch BS is turned on by the bias control voltage Vbias provided in response to an enablement of the output buffer 40, and provides the first voltage V1 to the first to fourth transistors TR1 to TR4.

The input multiplexer 45 of the input stage 46 may include first to fourth switches SW1 to SW4 connected to the first to fourth transistors TR1 to TR4, respectively. The first to fourth switches SW1 to SW4 may be implemented with NMOS transistors.

The input multiplexer 45 receives first and second select signals SEL1 and SEL2 which have inverted phase each other and have a periodically changing enable state. The first and second select signals SEL1 and SEL2 are provided to the input stage 46 of the output buffer 40 in synchronization with the SOE signal, and are digital signals which have inverted phase each other and have a high or low logical value. When the first and second select signals SEL1 and SEL2 are at a high level, it may indicate that the first and second select signals SEL1 and SEL2 are enabled to turn on the first to fourth switches SW1 to SW4.

The first select signal SEL1 may change to a high level in response to an even-numbered cycle of the SOE signal, and change to a low level in response to an odd-numbered cycle of the SOE signal. The second select signal SEL2 may change to a high level in response to an odd-numbered cycle of the SOE signal, and change to a low level in response to an even-numbered cycle of the SOE signal.

The first switch SW1 is operated by the first select signal SEL1 applied to the gate thereof, and controls an output of the first voltage driven by the first transistor TR1 in response to the first DAC signal. The second switch SW2 is operated by the second select signal SEL2 applied to the gate thereof, and controls an output of the second voltage driven by the second transistor TR2 in response to the second DAC signal. The third switch SW3 is operated by the first select signal SEL1 applied to the gate thereof, and controls an output of a third voltage driven by the third transistor TR3 in response to the first feedback voltage corresponding to a feedback signal of the source driving signal Bout1 outputted from the output buffer 40 in response to the first DAC signal. The fourth switch SW4 is operated by the second select signal SEL2 applied to the gate thereof, and controls an output of a fourth voltage driven by the fourth transistor TR4 in response to the second feedback voltage corresponding to a feedback signal of the source driving signal Bout1 outputted from the output buffer 40 in response to the second DAC signal.

The input multiplexer 45 may select the first voltage by the first transistor TR1 and the third voltage by the third transistor TR3 in response to the first select signal SEL1, and select the second voltage by the second transistor TR2 and the fourth voltage by the fourth transistor TR4 in response to the second select signal SEL2.

The input stage 46 may further include a comparison circuit (not illustrated) which compares the voltage outputted by the first and second switches SW1 and SW2 to the voltage outputted by the third and fourth switches SW3 and SW4, and outputs a comparison signal corresponding to a difference therebetween. The comparison signal of the comparison circuit is provided to the load and bias stage 47.

In other words, the input stage 46 generates the comparison signal corresponding to the first DAC signal and the first feedback voltage in response to an enablement of the first select signal SEL1 or generates the comparison signal corresponding to the second DAC signal and the second feedback voltage in response to an enablement of the second select signal SEL2, and provides the comparison signal to the load and bias stage 47.

More specifically, when the first select signal SEL1 is enabled to a high level, the input stage 46 compares the first voltage outputted through the first switch SW1 connected to the first transistor TR1 to the third voltage outputted through the third switch SW3 connected to the third transistor TR3, and provides a comparison signal corresponding to a difference between the first and third voltages to the load and bias stage 47.

At this time, the first transistor TR1 has already received the first DAC signal loaded at the preset level through the gate serving as the first input terminal 41, and the first switch SW1 outputs the first voltage transmitted through the first transistor TR1 in response to the first DAC signal. Furthermore, the third transistor TR3 receives the first feedback voltage through the gate serving as the third input terminal 43, the first feedback voltage corresponding to a feedback signal of the source driving signal Bout1 outputted from the output buffer 40 in response to the first DAC signal, and the third switch SW3 outputs the third voltage transmitted through the third transistor TR3 in response to the first feedback voltage.

When the second select signal SEL2 is enabled to a high level, the input stage 46 compares the second voltage outputted through the second switch SW2 connected to the second transistor TR2 to the fourth voltage outputted through the fourth switch SW4 connected to the fourth transistor TR4, and provides a comparison signal corresponding to a difference between the second and fourth voltages to the load and bias stage 47.

At this time, the second transistor TR2 has already received the second DAC signal loaded at the preset level through the gate serving as the second input terminal 42, and the second switch SW2 outputs the second voltage transmitted through the second transistor TR2 in response to the second DAC signal. The fourth transistor TR4 receives the second feedback voltage through the gate serving as the fourth input terminal 44, the second feedback voltage corresponding to a feedback signal of the source driving signal Bout1 outputted from the output buffer 40 in response to the second DAC signal, and the fourth switch SW4 outputs the fourth voltage transmitted through the fourth transistor TR4 in response to the second feedback voltage.

The comparison signal generated in such a manner is inputted to the load and bias stage 47. The load and bias stage 27 provides the pull-up driving signal and the pull-down driving signal, which are generated through the comparison signal, to the output stage 48.

The output stage 48 outputs the source driving signal Bout1 corresponding to the pull-up driving signal and the pull-down driving signal using the pull-up driver and the pull-down driver.

FIG. 3 is a waveform diagram illustrating an output waveform according to the embodiment of FIGS. 1 and 2.

Referring to FIG. 3, when the SOE signal enters the first cycle, the second select signal SEL2 changes to a high level, and the output buffer 40 selects the second DAC signal loaded at the preset level to the second input terminal 42 from a time point "OT" at which the first cycle is started, and outputs the selected signal as the source driving signal Bout. At this time, the first select signal SEL is at a low level. The first DAC signal of the first input terminal 41 of the output buffer 40 has been discharged in order to output the source driving signal Bout1 in the previous cycle of the first cycle, and is loaded from a time point "UT" at which the first cycle is started.

Then, when the SOE signal enters the second cycle, the first select signal SEL1 changes to a high level, and the output buffer 40 selects the first DAC signal from a time point "OT" at which the second cycle is started, the first DAC signal being loaded at the preset level to the first input terminal 41 during the first cycle, and outputs the selected signal as the source driving signal Bout. At this time, the second select signal SEL2 changes to a low level, and the second DAC signal of the second input terminal 42 of the output buffer 40 is loaded from a time point "UT" at which the second cycle is started.

As illustrated in FIG. 3, the output buffer 40 receives the first and second select signals SEL1 and SEL2 which have inverted phase while periodically changing, and outputs the source driving signal Bout1 by selecting and using the DAC signal loaded at the preset level.

As a result, the output buffer 40 may select a loaded grayscale voltage without an influence of input parasitic capacitance, and output the selected voltage as the source driving signal Bout1. Thus, the output buffer 40 can have an improved response characteristic, and output the source driving signal Bout1 without an RC delay by a DAC signal of an input terminal.

Figure 4:
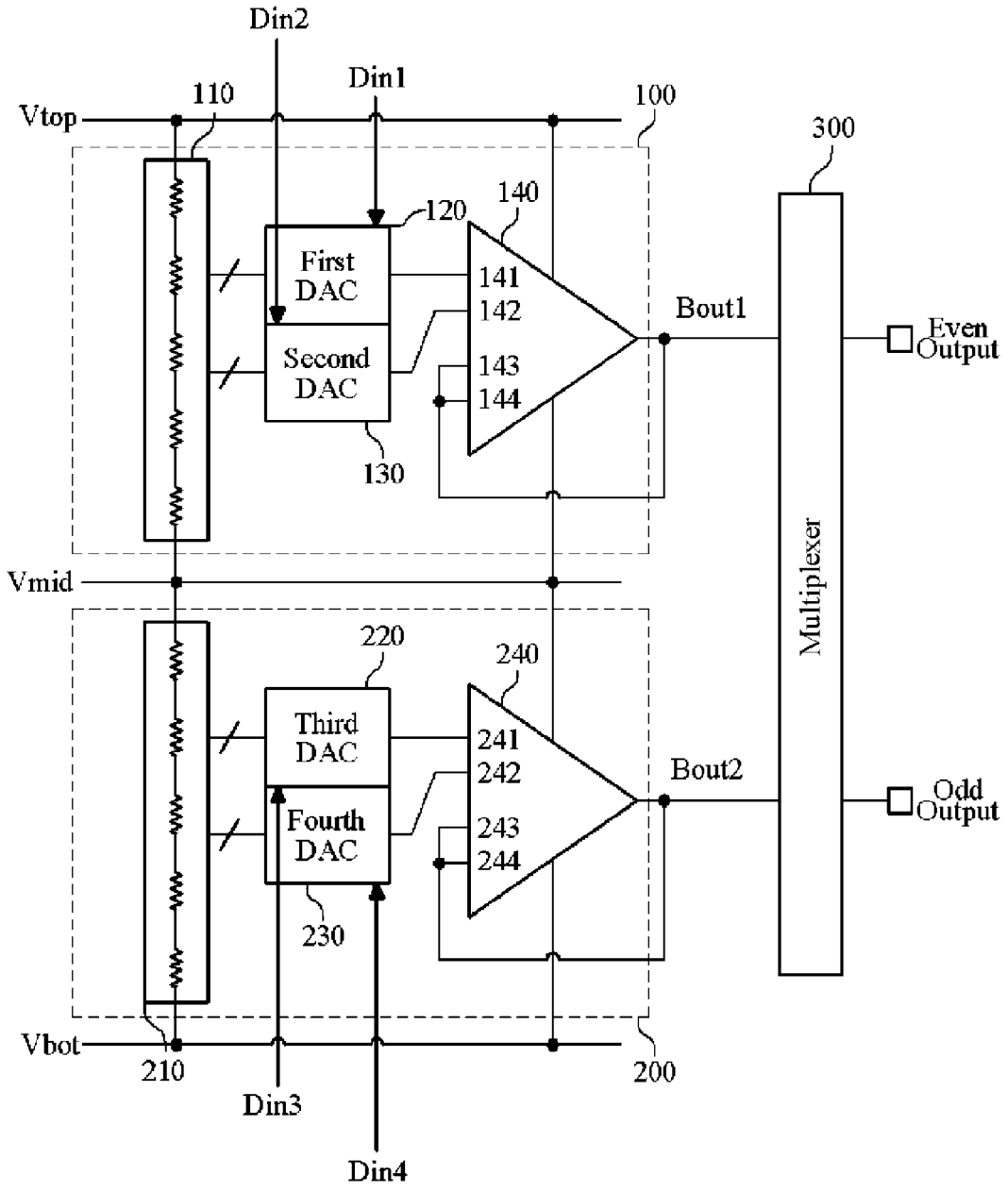
FIG. 4 is a circuit diagram illustrating a display driving device according to another embodiment of the present invention.

FIG. 4 is a circuit diagram illustrating a display driving device according to another embodiment of the present invention.

Referring to FIG. 4, the display driving device includes a first output unit 100, a second output unit 200 and a multiplexer 300.

The first output unit 100 may include a first gamma voltage provider 110, a first DAC 120, a second DAC 130 and a first output buffer 140, and the second output unit 200 may include a second gamma voltage provider 210, a third DAC 220, a fourth DAC 230 and a second output buffer 240.

The first output unit 100 is connected between a voltage terminal to provide a second supply voltage Vmid and a voltage terminal to provide a third supply voltage Vtop, and driven by the second supply voltage Vmid and the third supply voltage Vtop. The second output unit 200 is connected between a voltage terminal to provide a first supply voltage Vbot and the voltage terminal to provide the second supply voltage Vmid, and driven by the first supply voltage Vbot and the second supply voltage Vmid.

The first supply voltage Vbot has a lower level than the second supply voltage Vmid, and the third supply voltage Vtop has a higher level than the second supply voltage Vmid. Furthermore, the level of the second supply voltage Vmid may correspond to the intermediate value between the first supply voltage Vbot and the third supply voltage Vbot.

The first output unit 100 which is operated at a level equal to or higher than the second supply voltage Vmid may be considered as a positive output unit, and the second output unit 200 which is operated at a level less than the second supply voltage Vmid may be considered as a negative output unit.

The levels of the first to third supply voltages Vbot, Vmid and Vtop may have different values within the above-described range depending on a designer or driving environment of the display driving device.

The display driving device of FIG. 4 provides a first source driving signal Bout1 and a second source driving signal Bout2 to a display panel (not illustrated). The first source driving signal Bout1 is outputted by the first output unit 100 which is driven at a voltage level in a positive range based on the second supply voltage Vmid, and the second source driving signal Bout2 is outputted by the second output unit 200 which is driven at a voltage level in a negative range based on the second supply voltage Vmid.

At this time, the multiplexer 300 may change a channel to output the first and second source driving signals Bout1 and Bout2 in response to a polarity inversion signal (not illustrated) for controlling periodic polarity inversion of the source driving signal for a pixel. More specifically, the multiplexer 300 may provide a path for outputting the first driving signal Bout1 to an even output terminal Even Output and outputting the second source driving signal Bout2 to an odd output terminal Odd Output, or provide a path for outputting the first source driving signal Bout1 to the odd output terminal Odd Output and outputting the second driving signal Bout2 to the even output terminal Even Output.

According to the above-described configuration, the odd output terminal Odd Output and the even output terminal Even Output can output source driving signals having different polarities based on the second supply voltage Vmid through the multiplexer 300, and the pixels of the display panel can maintain a favorable image quality through the source driving signals of which the polarities are inverted.

The configurations and functions of the first and second output units 100 and 200 can be described with reference to FIGS. 1 and 2, except that the output units are driven in different voltage environments, and represented by different names in order to distinguish between the configurations thereof.

More specifically, the first gamma voltage provider 110 of the first output unit 100 provides a positive range of grayscale voltages to the first and second DACs 120 and 130, and the second gamma voltage provider 210 of the second output unit 200 provides a negative range of grayscale voltages to the third and fourth DACs 220 and 230.

The first and second DACs 120 and 130 of the first output unit 100 receive first and second digital data Din1 and Din2, and load first and second DAC signals. The third and fourth DACs 220 and 230 of the second output unit 200 receive third and fourth digital data Din3 and Din4, and load third and fourth DAC signals.

The first and third digital data Din1 and Din3 are included in a first horizontal line, and the second and fourth digital data Din2 and Din4 are included in a second horizontal line. At this time, the first horizontal line corresponds to an odd-numbered horizontal line of a frame, and the second horizontal line corresponds to an even-numbered horizontal line of the frame.

The first output buffer 140 of the first output unit 100 may include first to fourth input terminals 141 to 144 corresponding to the first to fourth input terminals 41 to 44 of the output buffer 40 of FIGS. 1 and 2, respectively. The first DAC signal is loaded to the first input terminal 141, the second DAC signal is loaded to the second input terminal 142, a first feedback voltage corresponding to the first DAC signal is received through the third input terminal 143, and a second feedback voltage corresponding to the second DAC signal is received through the fourth input terminal 144.

The second output buffer 240 may include fifth to eighth input terminals 241 to 244 corresponding to the first to fourth input terminals 41 to 44 of the output buffer 40 of FIGS. 1 and 2, respectively. The third DAC signal is loaded to the fifth input terminal 241, the fourth DAC signal is loaded to the sixth input terminal 242, a third feedback voltage corresponding to the third DAC signal is received through the seventh input terminal 243, and a fourth feedback voltage corresponding to the fourth DAC signal is received through the eighth input terminal 244.

Hereafter, the descriptions of configurations and functions of the embodiment of FIG. 4, which are the same as those of the embodiment of FIGS. 1 and 2, are omitted herein.

Each of the first and second output units 100 and 200 according to the embodiment of FIG. 4 selects a signal loaded at a preset level between the DAC signals loaded from the two DACs, in order to output the source driving signal. Therefore, since the first and second output units 100 and 200 selects the first or second DAC signal loaded at the preset level or more and outputs the source driving signal, the first and second output units 100 and 200 can reduce the time required for loading the DAC signals of the input terminals of the first and second output buffers 140 and 240, while having a quick response characteristic.

Therefore, the display driving device according to the embodiment of FIG. 4 can reduce a response delay of the output buffer, which may be caused by an input delay of a DAC signal, reduce a response delay of the output buffer by alternately using the two DACs, and remove the influence of a DAC delay on an operation of the display panel.

Therefore, the display driving device can process display data in response to a little line time for a high-resolution display.

While various embodiments have been described above, it will be understood to those skilled in the art that the embodiments described are by way of example only. Accordingly, the disclosure described herein should not be limited based on the described embodiments.

What is claimed is:

1. A display driving device comprising:

a first digital-to-analog converter (DAC) configured to output a first grayscale voltage corresponding to first digital data as a first DAC signal in an even cycle;

a second DAC configured to output a second grayscale voltage corresponding to second digital data as a second DAC signal in an odd cycle; and an output buffer comprising a first input terminal to which the first DAC signal is inputted and a second input terminal to which the second DAC signal is inputted, and configured to output a source driving signal by selecting a DAC signal loaded in a previous cycle of a current cycle between the first DAC signal loaded in the even cycle and the second DAC signal loaded in the odd cycle.

2. The display driving device of claim 1, wherein the output buffer receives a first select signal enabled in the odd cycle and a second select signal enabled in the even cycle, outputs the source driving signal by selecting the first DAC signal loaded to the first input terminal in the odd cycle before the current cycle in response to an enablement of the first select signal, and outputs the source driving signal by selecting the second DAC signal loaded to the second input terminal in the even cycle before the current cycle in response to an enablement of the second select signal.

3. The display driving device of claim 2, wherein the first select signal and the second select signal are synchronized with an enable timing of an output enable signal for controlling an output of the source driving signal.

4. The display driving device of claim 1, wherein the output buffer comprises:

an input stage comprising the first input terminal, the second input terminal, a third input terminal for receiving, as a first feedback voltage, a feedback signal of the source driving signal corresponding to the first DAC signal, and a fourth input terminal for receiving, as a second feedback voltage, a feedback signal of the source driving signal corresponding to the second DAC signal, and configured to receive the first select signal and the second select signal which have a periodically and alternately changing enable state, and generate a comparison signal corresponding to the first DAC signal loaded in the even cycle before the current cycle and the first feedback voltage in response to an enablement of the first select signal or generate the comparison signal corresponding to the second DAC signal loaded in the odd cycle before the current cycle and the second feedback voltage in response to an enablement of the second select signal;

a load and bias stage configured to generate a pull-up driving signal and a pull-down driving signal in response to the comparison signal; and an output stage configured to output the source driving signal using the pull-up driving signal and the pull-down driving signal.

5. The display driving device of claim 4, wherein the input stage comprises:

first to fourth transistors having the first to fourth input terminals formed at the respective gates thereof;

first to fourth switches connected to the first to fourth transistors, respectively; and a bias switch connected to the first to fourth transistors in common, and enabled by a bias voltage, wherein the first and third switches connected to the first and third transistors are controlled by the first select signal, and the second and fourth switches connected to the second and fourth transistors are controlled by the second select signal.

6. The device of claim 4, wherein the first and second select signals are synchronized with an enable timing of an output enable signal for controlling an output of the source driving signal, the first select signal is enabled in the odd cycle, and the second select signal is enabled in the even cycle.

7. The display driving device of claim 1, wherein the first DAC and the second DAC share one gamma voltage provider in order to receive the first grayscale voltage and the second grayscale voltage.

8. A display driving device comprising:

a first output unit configured to output a first source driving signal in a negative range of a first supply voltage to a second supply voltage;

a second output unit configured to output a second source driving signal in a positive range of the second supply voltage to a third supply voltage; and a multiplexer configured to control paths through which the first source driving signal and the second source driving signal are outputted to a display panel, wherein the first output unit comprises:

a first DAC configured to output a first grayscale voltage of the negative range in response to first digital data as a first DAC signal in an even cycle;

a second DAC configured to output a second grayscale voltage of the negative range response to second digital data as a second DAC signal in an odd cycle; and a first output buffer comprising a first input terminal to which the first DAC signal is inputted and a second input terminal to which the second DAC signal is inputted, and configured to output the first source driving signal by selecting a DAC signal loaded in a previous cycle of a current cycle between the first DAC signal loaded in the even cycle and the second DAC signal loaded in the odd cycle wherein the second output unit comprises:

a third DAC configured to output a third grayscale voltage of the positive range in response to third digital data as a third DAC signal in the even cycle;

a fourth DAC configured to output a fourth grayscale voltage of the positive range in response to fourth digital data as a fourth DAC signal in the odd cycle; and a second output buffer comprising a third input terminal to which the third DAC signal is inputted and a fourth input terminal to which the fourth DAC signal is inputted, and configured to output the second source driving signal by selecting a DAC signal loaded in a previous cycle of a current cycle between the third DAC signal loaded in the even cycle and the fourth DAC signal loaded in the odd cycle.

9. The display driving device of claim 8, wherein the first output buffer comprises the first input terminal, the second input terminal, a fifth input terminal for receiving, as a first feedback voltage, a feedback signal of the first source driving signal corresponding to the first DAC signal, and a sixth input terminal for receiving, as a second feedback voltage, a feedback signal of the first source driving signal corresponding to the second DAC signal, receives a first select signal and a second select signal which have a periodically and alternately changing enable state, generates a first comparison signal corresponding to the first DAC signal loaded in the even cycle before the current cycle and the first feedback voltage in response to an enablement of the first select signal or generates the first comparison signal corresponding to the second DAC signal loaded in the odd cycle before the current cycle and the second feedback voltage in response to an enablement of the second select signal, and outputs the first source driving signal corresponding to the first comparison signal, and the second output buffer comprises the third input terminal, the fourth input terminal, a seventh input terminal for receiving, as a third feedback voltage, a feedback signal of the second source driving signal corresponding to the third DAC signal, and an eighth input terminal for receiving, as a fourth feedback voltage, a feedback signal of the second source driving signal corresponding to the fourth DAC signal, receives the first select signal and the second select signal, generates a second comparison signal corresponding to the third DAC signal loaded in the even cycle before the current cycle and the third feedback voltage in response to an enablement of the first select signal or generates the second comparison signal corresponding to the fourth DAC signal loaded in the odd cycle before the current cycle and the fourth feedback voltage in response to an enablement of the second select signal, and outputs the second source driving signal corresponding to the second comparison signal.

10. The display driving device of claim 9, wherein the first output buffer comprises:

a first input stage comprising the first input terminal, the second input terminal, the fifth input terminal and the sixth input terminal, and configured to generate the first comparison signal corresponding to the first DAC signal loaded in the even cycle before the current cycle and the first feedback voltage according to the first select signal or generate the first comparison signal corresponding to the second DAC signal loaded in the odd cycle before the current cycle and the second feedback voltage in response to an enablement of the second select signal;

a first load and bias stage configured to generate a first pull-up driving signal and a first pull-down driving signal in response to the first comparison signal; and a first output stage configured to output the first source driving signal using the first pull-up driving signal and the first pull-down driving signal, wherein the second output buffer comprises:

a second input stage comprising the third input terminal, the fourth input terminal, the seventh input terminal and the eighth input terminal, and configured to generate the second comparison signal corresponding to the third DAC signal loaded in the even cycle before the current cycle and the third feedback voltage according to the first select signal or generate the second comparison signal corresponding to the fourth DAC signal loaded in the odd cycle before the current cycle and the fourth feedback voltage in response to an enablement of the second select signal;

a second load and bias stage configured to generate a second pull-up driving signal and a second pull-down driving signal in response to the second comparison signal; and a second output stage configured to output the second source driving signal using the second pull-up driving signal and the second pull-down driving signal.

11. The display driving device of claim 10, wherein the first input stage comprises:

first to fourth transistors having the first, second, fifth and sixth input terminals formed at the respective gates thereof;

first to fourth switches connected to the first to fourth transistors, respectively; and a first bias switch connected to the first to fourth transistors in common, and enabled by a bias voltage, wherein the first switch connected to the first transistor to which the first DAC signal is inputted and the third switch connected to the third transistor to which the second DAC signal is inputted are controlled by the first select signal, and the second switch connected to the second transistor which receives the first feedback voltage and the fourth switch connected to the fourth transistor which receives the second feedback voltage are controlled by the second select signal, wherein the second input stage comprises:

fifth to eighth transistors having the third, fourth, seventh and eighth input terminals formed at the respective gates thereof;

fifth to eighth switches connected to the fifth to eighth transistors, respectively; and a second bias switch connected to the fifth to eighth transistors in common, and enabled by the bias voltage, wherein the fifth switch connected to the fifth transistor to which the third DAC signal is inputted and the sixth switch connected to the sixth transistor to which the fourth DAC signal is inputted are controlled by the first select signal, and the seventh switch connected to the seventh transistor which receives the third feedback voltage and the eighth switch connected to the eighth transistor which receives the fourth feedback voltage are controlled by the second select signal.

12. The display driving device of claim 9, wherein the first select signal and the second select signal are synchronized with an enable timing of an output enable signal for controlling an output of the first source driving signal and the second source driving signal, the first select signal is enabled in the odd cycle, and the second select signal is enabled in the even cycle.

13. The display driving device of claim 8, wherein the first DAC and the second DAC share one first gamma voltage provider in order to receive the first grayscale voltage and the second grayscale voltage, and the third DAC and the fourth DAC share one second gamma voltage provider in order to receive the third gamma voltage and the fourth gamma voltage.

14. The display driving device of claim 8, wherein the second supply voltage has an intermediate value between the first supply voltage and the third supply voltage, the first source driving signal is a negative signal having a level equal to or lower than the second supply voltage, and the second source driving signal is a positive signal having a higher level than the second supply voltage.

15. The display driving device of claim 8, wherein the first digital data and the third digital data are included in a first horizontal line, the second digital data and the fourth digital data are included in a second horizontal line, the first horizontal line corresponds to an odd-numbered horizontal line of a frame, and the second horizontal line corresponds to an even-numbered horizontal line of the frame.

16. A display driving device comprising:

a gamma voltage provider configured to provide a plurality of gamma voltages;

a first DAC configured to output a first grayscale voltage corresponding to first digital data among the plurality of gamma voltages of the gamma voltage provider in an even cycle;

a second DAC configured to output a second grayscale voltage corresponding to second digital data among the plurality of gamma voltages of the gamma voltage provider in an odd cycle; and an output buffer comprising a first input terminal loaded with the first grayscale voltage, a second input terminal loaded with the second grayscale voltage, and an input multiplexer alternately selecting the first grayscale voltage of the first input terminal and the second grayscale voltage of the second input terminal, and configured to output a source driving signal corresponding to a grayscale voltage selected by the input multiplexer;

wherein the input multiplexer receives a first select signal and a second select signal which have a periodically and alternately changing enable state, selects the first grayscale voltage loaded to the first input terminal in the even cycle, before a current cycle in response to an enablement of the first select signal, and selects the second grayscale voltage loaded to the second input terminal in the odd cycle, before the current cycle in response to an enablement of the second select signal.

* * * * *